US011739282B2

(12) United States Patent
Hoey et al.

(10) Patent No.: US 11,739,282 B2
(45) Date of Patent: Aug. 29, 2023

(54) LUBRICANT COMPOSITION

(71) Applicant: BASF SE, Ludwigshafen am Rhein (DE)

(72) Inventors: Michael Hoey, Tarrytown, NY (US); David Eliezer Chasan, Tarrytown, NY (US); Jeffrey Schoonmaker, Tarrytown, NY (US); Ryan James Fenton, Tarrytown, NY (US)

(73) Assignee: BASF SE, Ludwigshafen am Rhein (DE)

( * ) Notice: Subject to any disclaimer, the term of this patent is extended or adjusted under 35 U.S.C. 154(b) by 45 days.

(21) Appl. No.: 17/440,467

(22) PCT Filed: Mar. 16, 2020

(86) PCT No.: PCT/US2020/022953
§ 371 (c)(1),
(2) Date: Sep. 17, 2021

(87) PCT Pub. No.: WO2020/190859
PCT Pub. Date: Sep. 24, 2020

(65) Prior Publication Data

US 2022/0356413 A1 Nov. 10, 2022

Related U.S. Application Data

(60) Provisional application No. 62/821,007, filed on Mar. 20, 2019.

(51) Int. Cl.

| | |
|---|---|
| ***C10M 141/08*** | (2006.01) |
| ***C10M 133/12*** | (2006.01) |
| ***C10M 135/22*** | (2006.01) |
| ***C10M 135/26*** | (2006.01) |
| ***C10M 169/04*** | (2006.01) |
| ***C10M 135/04*** | (2006.01) |
| *C10N 40/00* | (2006.01) |
| *C10N 30/00* | (2006.01) |
| *C10N 30/06* | (2006.01) |
| *C10N 30/10* | (2006.01) |
| *C10N 30/12* | (2006.01) |
| *C10N 40/02* | (2006.01) |
| *C10N 40/25* | (2006.01) |

(52) U.S. Cl.
CPC ..... *C10M 141/08* (2013.01); *C10M 133/12* (2013.01); *C10M 135/04* (2013.01); *C10M 135/22* (2013.01); *C10M 135/26* (2013.01); *C10M 169/04* (2013.01); *C10M 2203/003* (2013.01); *C10M 2215/064* (2013.01); *C10M 2215/065* (2013.01); *C10M 2215/26* (2013.01); *C10M 2219/022* (2013.01); *C10M 2219/082* (2013.01); *C10M 2219/085* (2013.01); *C10N 2030/06* (2013.01); *C10N 2030/10* (2013.01); *C10N 2030/12* (2013.01); *C10N 2030/43* (2020.05); *C10N 2040/02* (2013.01); *C10N 2040/135* (2020.05); *C10N 2040/25* (2013.01)

(58) Field of Classification Search
CPC ..... C10M 141/08; C10M 133/12; C10M 135/04; C10M 169/04; C10M 2203/003; C10M 2215/064; C10M 2215/065; C10M 2215/26; C10M 2219/022; C10M 2219/082; C10M 2219/085; C10M 157/06; C10M 2205/0285; C10M 2207/10; C10M 2207/28; C10M 2207/288; C10M 2209/103; C10M 2215/223; C10M 2219/084; C10M 2223/043; C10N 2030/06; C10N 2030/10; C10N 2030/12; C10N 2030/43; C10N 2040/25
See application file for complete search history.

(56) References Cited

U.S. PATENT DOCUMENTS

| | | | |
|---|---|---|---|
| 2,537,283 | A | 1/1951 | Schaad |
| 2,817,693 | A | 12/1957 | Koome et al. |
| 3,211,801 | A | 10/1965 | Holm et al. |

(Continued)

FOREIGN PATENT DOCUMENTS

| | | | |
|---|---|---|---|
| EP | 0464546 | A1 | 1/1992 |
| EP | 0464547 | A1 | 1/1992 |

(Continued)

OTHER PUBLICATIONS

Allen, et al., "Y-Chloropropyl Acetate", Organic Syntheses, vol. 3, 1955, p. 203.

(Continued)

*Primary Examiner* — Prem C Singh
*Assistant Examiner* — Francis C Campanell
(74) *Attorney, Agent, or Firm* — Faegre Drinker Biddle & Reath LLP

(57) ABSTRACT

Lubricant compositions comprising a base oil, one or more antioxidants selected from a group consisting of N-α-naphthyl-N-phenylamine antioxidants and diphenylamine antioxidants; and a sulfur-containing additive comprising up to seven carbon atoms exhibit outstanding oxidative stability and non-corrosion properties. The N-α-naphthyl-N-phenylamine antioxidants plus diphenylamine antioxidants in total may be present from about 0.2 wt % to about 0.8 wt %, based on the total weight of the lubricant composition. The sulfur provided by the sulfur-containing additive may be present from about 50 ppm to about 1000 ppm by weight, based on the total weight of the lubricant composition.

14 Claims, No Drawings

(56) References Cited

U.S. PATENT DOCUMENTS

| | | | | |
|---|---|---|---|---|
| 3,270,085 | A | 8/1966 | Noddings et al. | |
| 3,304,343 | A | 2/1967 | Mitsutani | |
| 3,327,014 | A | 6/1967 | Noddings | |
| 3,382,291 | A | 5/1968 | Brennan | |
| 3,448,164 | A | 6/1969 | Holm et al. | |
| 3,471,404 | A | 10/1969 | Myers | |
| 3,697,499 | A | 10/1972 | Myers | |
| 3,703,504 | A | 11/1972 | Horodysky | |
| 3,723,564 | A | 3/1973 | Tidwell et al. | |
| 3,742,082 | A | 6/1973 | Brennan | |
| 3,769,363 | A | 10/1973 | Brennan | |
| 3,876,720 | A | 4/1975 | Heilman et al. | |
| 4,149,178 | A | 4/1979 | Estes | |
| 4,194,980 | A | 3/1980 | Braid | |
| 4,218,330 | A | 8/1980 | Shubkin | |
| 4,239,930 | A | 12/1980 | Allphin et al. | |
| 4,344,854 | A | 8/1982 | Davis et al. | |
| 4,367,352 | A | 1/1983 | Watts et al. | |
| 4,413,156 | A | 11/1983 | Watts et al. | |
| 4,434,408 | A | 2/1984 | Baba et al. | |
| 4,593,146 | A | 6/1986 | Johnson et al. | |
| 4,594,172 | A | 6/1986 | Sie | |
| 4,827,064 | A | 5/1989 | Wu | |
| 4,827,073 | A | 5/1989 | Wu | |
| 4,897,178 | A | 1/1990 | Best et al. | |
| 4,910,355 | A | 3/1990 | Shubkin et al. | |
| 4,921,594 | A | 5/1990 | Miller | |
| 4,943,672 | A | 7/1990 | Hamner et al. | |
| 4,956,122 | A | 9/1990 | Watts et al. | |
| 4,975,177 | A | 12/1990 | Garwood et al. | |
| 5,068,487 | A | 11/1991 | Theriot | |
| 5,075,269 | A | 12/1991 | Degnan et al. | |
| 5,135,670 | A | 8/1992 | Johnson et al. | |
| 5,338,468 | A * | 8/1994 | Arvizzigno | C10M 135/04 508/569 |
| 5,849,677 | A | 12/1998 | Romanelli | |
| 6,080,301 | A | 6/2000 | Berlowitz et al. | |
| 6,090,989 | A | 7/2000 | Trewella et al. | |
| 6,165,949 | A | 12/2000 | Berlowitz et al. | |
| 6,207,623 | B1 | 3/2001 | Butler et al. | |
| 6,281,404 | B1 | 8/2001 | Miller | |
| 6,326,336 | B1 * | 12/2001 | Gatto | C10M 141/08 508/331 |
| 6,410,491 | B1 | 6/2002 | Harrison et al. | |
| 7,544,645 | B2 | 6/2009 | Miller et al. | |
| 2005/0153850 | A1 | 7/2005 | Nelson et al. | |
| 2009/0159837 | A1 | 6/2009 | Kramer et al. | |
| 2009/0198075 | A1 | 8/2009 | Miller et al. | |

FOREIGN PATENT DOCUMENTS

| | | | |
|---|---|---|---|
| EP | 0994175 | A2 | 4/2000 |
| GB | 1350257 | A | 4/1974 |
| GB | 1390359 | A | 4/1975 |
| GB | 1429494 | A | 3/1976 |
| GB | 1440230 | A | 6/1976 |

OTHER PUBLICATIONS

Eliel et al., "Alpha-Chlorophenylacetic Acid", Organic Syntheses, vol. 4, 1963, p. 169.

European Search Report for EP Patent Application No. 20164380.6, dated Jul. 21, 2020, 3 pages.

Fersht et al., "Acetylpyridinium ion intermediate in pyridine-catalyzed hydrolysis and acyl transfer reactions of acetic anhydride. Observation, kinetics, structure-reactivity correlations, and effects of concentrated salt solutions", Journal of the American Chemical Society, vol. 92, Issue 18, Sep. 1, 1970, pp. 5432-5442.

Hofle et al., "4-Dialkylaminopyridines as highly active acylation catalysts.[New synthetic method (25)]", Angewandte Chemie International, vol. 17, Issue 8, Aug. 1978, pp. 569-583.

International Preliminary Report on Patentability received for PCT Patent Application No. PCT/US2020/022953, dated Sep. 30, 2021, 10 pages.

International Search Report and Written Opinion received for PCT Patent Application No. PCT/US2020/022953, dated Jul. 14, 2020, 12 pages.

Jon Munch-Petersen, "3-Methylheptanoic Acid", Organic Syntheses, vol. 5, 1973, p. 762.

Martin Schroeder, "Osmium tetraoxide cis hydroxylation of unsaturated substrates", Chemical Reviews, vol. 80, Issue 2, Apr. 1, 1980, pp. 187-213.

Parker, et al., "Mechanisms of Epoxide Reactions", Chemical Reviews, vol. 59, Issue 4, Aug. 1, 1959, pp. 737-799.

Paterson, et al., "Meso Epoxides in Asymmetric Synthesis: Enantioselective Opening by Nucleophiles in the Presence of Chiral Lewis Acids", Angewandte Chemie International, vol. 31, Issue 9, Sep. 1992, pp. 1179-1180.

* cited by examiner

LUBRICANT COMPOSITION

CROSS-REFERENCE TO RELATED APPLICATIONS

This application is a national stage application (under 35 U.S.C. § 371) of PCT/US2020/022953, filed Mar. 16, 2020, which claims benefit of U.S. Application No. 62/821,007, filed Mar. 20, 2019, both of which are incorporated herein by reference in their entirety.

FIELD OF THE INVENTION

This disclosure relates to formulated lubricant compositions with oxidative stability and non-corrosion properties. In particular, this disclosure relates to lubricants, methods for improving oxidative stability and non-corrosion properties of lubricants employed in a turbine gearbox and/or on turbine bearings or an engine and to additive packages for use in lubricants.

BACKGROUND

Industrial turbines are used to convert kinetic energy into power. The most common industrial turbines are steam turbines, gas turbines and hydraulic turbines. Though varying considerably in complexity, their basic designs are essentially the same across the turbine types. Accordingly, suitable lubricants can be specifically formulated for a single type of turbine, or formulated for multiple types. Turbine oils thus share certain features, such as, for example, the basic capacity to provide reliable lubrication and performance under high operating temperatures for sustained periods of time.

Steam turbines are among the most efficient of heat engines. They are typically used to drive machines such as electric generators, compressors and pumps, by converting the heat of steam to velocity or kinetic energy and then to mechanical energy. Aside from the major components, such as nozzles, valves, turbine blades, exhausts, and bearings, steam turbines also typically comprise a number of auxiliary systems that insure their safe and efficient operation. One of those auxiliary systems is the lubricating oil system, which provides clean, cool lubricating oil to the steam turbine bearings at the correct pressure, temperature, and flow rate. Certain of the steam turbines are equipped with mechanical-hydraulic control systems wherein the lubricating oil systems also lubricate the hydraulics. The exceedingly high operating temperatures and the otherwise harsh conditions in steam turbines place certain taxing demands on the oils, requiring, for example, sufficiently unvaried viscosity throughout the operating temperatures; resistance to fire, oxidation, sludge/varnish formation, and foaming; and anti-corrosion properties.

Gas turbines are commonly used in the electrical power industry to drive generators, compressors and pumps by converting part of a fuel's chemical energy into useable mechanical energy. A gas turbine, like a steam turbine, comprises major components and auxiliary systems, with the latter comprising a lubricating oil system in addition to others. In a small number of gas turbines the lubricant oils are insulated from heat, but in a majority of gas turbines, bearings and other major components are exposed to high operating temperatures, and in localized areas, these temperatures can be higher than those found in typical steam turbines. The capabilities of gas turbine oils to rapidly cool the surfaces without catching fire and retaining performance under extreme heat are thus put to the test. Even in the small number of gas turbines where the lubricant oils are not heated, however, oxidative stress remains because turbines typically undergo long periods of operation without oil service. Accordingly, a suitable gas turbine oil, like a suitable steam turbine oil, should not only provide clean and cool lubrication to the components, but also be fire resistant and impervious or nearly impervious to oxidation, rusting and/or corrosion.

Hydraulic turbines are typically found in hydroelectric power plants, wherein they convert the energy of falling water into mechanical work. In hydraulic turbines, the main parts requiring lubrication are the shaft bearings, the wicket gates and the inlet valves. The lubricating oil is typically not subject to high temperatures, but its capacity to separate water from oil takes on added importance because of the ever presence of water in the operating environment. Accordingly, a suitable hydraulic turbine oil will have superior water separating capacity as well as the capacity to maintain adequate fluidity at low temperatures. It will also have sufficient capacity to resist rust and corrosion, as well as the capacity to settle harmful water rapidly. Because of the large amounts of water in the environment, a suitable hydraulic turbine oil will have minimum tendency to foam, retain air, and/or form sludge.

A suitable general-application turbine oil will have a series of desirable properties to accommodate various operating conditions across multiple types of modern industrial turbines. These properties include, for example, sufficiently high viscosity index (VI), adequate oxidation stability (and relatedly, long life), low varnish/sludge formation, high fire resistance, good water-separation capacity, improved rust and/or corrosion resistance and improved air release and foaming properties. Desired are improved lubricant compositions having improved oxidation stability and anti-corrosion properties, for example improved turbine oils, rust & oxidation oils, ashless hydraulic fluids, ashless driveline fluids or an ashless engine/crankcase lubricant.

SUMMARY

Accordingly, disclosed is a lubricant composition comprising a base oil, one or more antioxidants selected from a group consisting of N-α-naphthyl-N-phenylamine antioxidants and diphenylamine antioxidants; and a sulfur-containing additive comprising up to 7 carbon atoms. In some embodiments, the N-α-naphthyl-N-phenylamine antioxidants plus diphenylamine antioxidants, in total, are present from about 0.2 wt % to about 0.8 wt %, based on the total weight of the lubricant composition. In other embodiments, the sulfur provided by the sulfur-containing additive may be present from about 50 ppm to about 1000 ppm by weight, based on the total weight of the lubricant composition.

Also disclosed is an additive package comprising a) one or more N-α-naphthyl-N-phenylamine antioxidants and/or b) one or more diphenylamine antioxidants; and c) a sulfur-containing additive comprising up to 7 carbon atoms. In some embodiments, c) is present from about 2 wt % to about 30 wt %, based on the total weight of a)+b)+c).

Also disclosed is a process for preparing a lubricant composition, the process comprising incorporating one or more antioxidants selected from a group consisting of N-α-naphthyl-N-phenylamine antioxidants and diphenylamine antioxidants; and a sulfur-containing additive comprising up to 7 carbon atoms; into a base oil. In some embodiments, the N-α-naphthyl-N-phenylamine antioxidants plus diphenylamine antioxidants, in total, are present from about 0.2 wt % to about 0.8 wt %, based on the total weight of the lubricant composition. In other embodiments, the sulfur provided by the sulfur-containing additive may be present from about 50 ppm to about 1000 ppm by weight, based on the total weight of the lubricant composition.

Also disclosed is a process for lubricating a turbine or an engine, the process comprising adding the lubricant composition as described herein to a turbine gearbox and/or to turbine bearings or to an engine.

DETAILED DESCRIPTION

The base oil, or lubricating base oil or base stock, is the largest component by weight of a finished fully formulated lubricating oil.

Lubricating base oils that may be useful in the present disclosure are both natural oils and synthetic oils as well as unconventional oils (or mixtures thereof) which can be used unrefined, refined, or re-refined (the latter is also known as reclaimed or reprocessed oil). Unrefined oils are those obtained directly from a natural or synthetic source and used without added purification. These include shale oil obtained directly from retorting operations, petroleum oil obtained directly from primary distillation and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration and percolation. Re-refined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of from 80 to 120 and contain greater than 0.03% sulfur and/or less than 90% saturates. Group II base stocks have a viscosity index of from 80 to 120, and contain less than or equal to 0.03% sulfur and greater than or equal to 90% saturates. Group III base stocks have a viscosity index greater than 120 and contain less than or equal to 0.03% sulfur and greater than 90% saturates. Group IV includes polyalphaolefins (PAO). Group V base stock includes base stocks not included in Groups I-IV. The table below summarizes properties of each of these five groups.

| | saturates | sulfur | viscosity index |
|---|---|---|---|
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | ---- polyalphaolefins (PAO) ---- | | |
| Group V | ---- all other base stocks not of Groups I-IV ---- | | |

Natural oils include animal oils, vegetable oils (castor oil and lard oil, for example), and mineral oils. Animal and vegetable oils possessing favorable thermal oxidative stability can be used. In a certain embodiment, natural oils include mineral oils. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_6$, $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PRO's may be made in viscosities up to 100 cSt (100° C.). The PAOs may typically comprise relatively low molecular weight hydrogenated polymers or oligomers of alphaolefins which include, but are not limited to, $C_2$ to $C_{32}$ alphaolefins, for example $C_8$ to $C_{16}$ alphaolefins, such as 1-hexene, 1-octene, 1-decene, 1-dodecene and the like. Polyalphaolefins may include poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 cSt. PAO fluids of particular use may include 3.0 cSt, 3.4 cSt, and/or 3.6 cSt and combinations thereof. Bi-modal mixtures of PAO fluids having a viscosity range of 1.5 to about 100 cSt or to about 300 cSt may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, for example a zeolitic catalyst. For example, one useful catalyst is ZSM-48 as described in U.S. Pat. No. 5,075,269. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of 3 cSt or 3.5 cSt to 25 cSt, 30 cSt or 50 cSt, as exemplified by GTL 4 with kinematic viscosity of 4.0 cSt at 100° C. and a viscosity index of 141. These Gas-to-Liquids (GTL) base oils, Fischer-Tropsch wax derived base oils, and other wax-derived hydroisomerized base oils may have useful pour points of −20° C. or lower, and under some conditions may have advantageous pour points of −25° C. or lower, with useful pour points of −30° C. to −40° C. or lower. Useful compositions of Gas-to-Liquids (GTL) base oils, Fischer-Tropsch wax derived base oils, and wax-derived hydroisomerized base oils are recited for example in U.S. Pat. Nos. 6,080,301; 6,090,989 and 6,165,949.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$, for example from $C_8$ to $C_{20}$. A mixture of hydrocarbyl groups may be advantageous, and up to three such substituents may be present.

The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. for the hydrocarbyl aromatic component may be from about 3 cSt or about 3.4 cSt to about 20 cSt or about 50 cSt. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be from about 2% or about 4% to about 15%, about 20% or about 25%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, BF3, or HF may be used. In some cases, milder catalysts include $FeCl_3$ or $SnCl_4$. Newer alkylation technology uses zeolites or solid super acids.

Esters comprise a useful base stock, for example esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di-(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters may be those which are obtained by reacting one or more polyhydric alcohols, for example hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, for instance $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company. In a certain embodiment, a synthetic ester includes trimethylolpropane trinonoate.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

In certain embodiments, diesters are suitable base stocks and may be formed by esterification of linear or branched $C_6$-$C_{15}$ aliphatic alcohols with one or more dibasic acids such as adipic, sebacic or azelaic acids. Examples of diesters are di-2-ethylhexyl sebacate and dioctyl adipate. A synthetic polyol ester base oil may be formed by esterification of an aliphatic polyol with carboxylic acid. An aliphatic polyol may contain from 4 to 15 carbon atoms and have from 2 to 8 hydroxyl groups. Examples of polyols include trimethylolpropane, pentaerythritol, dipentaerythritol, neopentyl glycol, tripentaerythritol and mixtures thereof.

In certain embodiments, a carboxylic acid reactant used to produce a synthetic polyol ester base oil is selected from aliphatic monocarboxylic acid or a mixture of aliphatic monocarboxylic acid and aliphatic dicarboxylic acid. The carboxylic acid may contain from 4 to 12 carbon atoms and may be straight or branched chain aliphatic acids. Mixtures of monocarboxylic acids may be used. In one embodiment, a polyol ester base oil is prepared from technical pentaerythritol and a mixture of $C_4$-$C_{12}$ carboxylic acids. Technical pentaerythritol is a mixture that includes about 85 to about 92 wt % monopentaerythritol and about 8 to about 15 wt % dipentaerythritol. A typical commercial technical pentaerythritol contains about 88 wt % monopentaerythritol and about 12 wt % of dipentaerythritol.

Other useful fluids of lubricating viscosity include non-conventional or unconventional base stocks that have been processed, e.g. catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); for example hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, for example F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of about −5° C. to about −40° C. or lower (ASTM D97). They may also be characterized as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived may advantageously be an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating oils useful in the present disclosure are any of the variety of oils corresponding to API Group I, Group II, Group III, Group IV, and Group V oils and mixtures thereof, in some embodiments API Group II, Group III, Group IV, and Group V oils and mixtures thereof, in certain embodiments the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. In regard to the Group II stocks, in some embodiments the Group II stock may be in the higher quality range associated with that stock, i.e. a Group II stock having a viscosity index in the range 100 cSt<VI<120 cSt.

The lubricating base oil or base stock constitutes the major component of the lubricant composition of the present disclosure. In an embodiment, a lubricating oil base stock for the inventive lubricant composition is from any of about 80 wt % (weight percent), about 81 wt %, about 82 wt %, about 83 wt %, about 84 wt %, about 85 wt %, about 86 wt %, about 87 wt % or about 88 wt % to any of about 89 wt %, about 90 wt %, about 91 wt %, about 92 wt %, about 93 wt %, about 94 wt %, about 95 wt %, about 96 wt %, about 97 wt %, about 98 wt %, about 99 wt %, about 99.1 wt %, about 99.2 wt %, about 99.3 wt %, about 99.4 wt %, about 99.5 wt %, about 99.6 wt % or about 99.7 wt %, based on the total weight of the fully formulated lubricant composition.

Group III base stocks may be GTL and Yubase Plus (hydroprocessed base stock). Group V base stocks may include alkylated naphthalene, synthetic esters and combinations thereof.

In some embodiments, the base oils or base stocks described above have a kinematic viscosity, according to ASTM standards, of about 2.5 cSt or about 4 cSt to any of about 6 cSt, about 8 cSt or about 9 cSt, about 12 cSt (or $mm^2/s$) at 100° C. In other embodiments, base stocks may have a kinematic viscosity of up to about 100 cSt, about 150 cSt, about 200 cSt, about 250 cSt or about 300 cSt at 100° C.

In some embodiments, a base stock may comprise a random or block polyalkylene glycol copolymer comprising ethylene oxide and propylene oxide units. A copolymer may comprise from any of about 30 wt %, about 50 wt % or about 60 wt % to any of about 70 wt %, about 85 wt % or about 95 wt % ethylene oxide units with the remainder being propylene oxide units.

In certain embodiments, a base oil comprises those selected from the group consisting of API groups II, III and IV. Included are GTL derived base oils. One or more base oils selected from groups II, III and IV may be combined with one or more esters as described above, for instance one or more diesters and/or triesters. In such mixtures, an ester may be present from any of about 0.5 wt %, about 1 wt %, about 2 wt %, about 3 wt %, about 4 wt %, about 5 wt %, about 6 wt %, about 7 wt % or about 8 wt % to any of about 9 wt %, about 10 wt %, about 11 wt %, about 12 wt %, about 13 wt %, about 14 wt % or about 15 wt %, based on a fully formulated lubricating oil.

In certain embodiments, the lubricant composition is a turbine oil, a rust & oxidation oil, an ashless hydraulic fluid, an ashless driveline fluid or an ashless engine/crankcase lubricant.

In some embodiments, a diester component has the following structure:

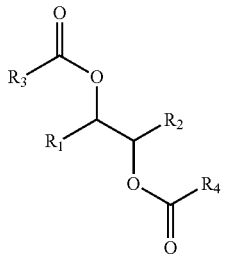

wherein $R_1$, $R_2$, $R_3$, and $R_4$ are independently a straight or branched chain $C_2$ to $C_{17}$ hydrocarbon group.

In some embodiments, $R_1$, $R_2$, $R_3$ and $R_4$ are selected such that the kinematic viscosity of the composition at a temperature of 100° C. is about 3 $mm^2/sec$ or greater. In some or other embodiments, $R_1$, $R_2$, $R_3$ and $R_4$ are selected such that the pour point of the resulting formulated oil is about −10° C. or lower, about −25° C. or lower or about −40° C. or lower. In some embodiments, $R_1$ and $R_2$ are selected to have a combined carbon number (i.e., total number of carbon atoms) of from 6 to 14. In these or other embodiments, $R_3$ and $R_4$ are selected to have a combined carbon number of from 10 to 34. Depending on the embodiment, such resulting diester species can have a molecular mass from about 340 atomic mass units (amu) to about 780 amu.

In some embodiments, a diester component is substantially homogeneous. In some or other embodiments, a diester component comprises a variety (i.e., a mixture) of diester species.

In some embodiments, the diester component comprises at least one diester species derived from a $C_8$ to $C_{16}$ olefin and a $C_2$ to $C_{18}$ carboxylic acid. A diester species may be prepared by reacting each —OH group (on the intermediate) with a different acid, but such diester species can also be made by reacting each —OH group with the same acid.

In some embodiments, a diester component comprises a diester species selected from the group consisting of decanoic acid 2-decanoyloxy-1-hexyl-octyl ester and its isomers, tetradecanoic acid-1-hexyl-2-tetradecanoyloxy-octyl esters and its isomers, dodecanoic acid 2-dodecanoylaxy-1-hexyl-octyl ester and its isomers, hexanoic acid 2-hexanoyloxy-1-hexy-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid-2-cecanoyloxy-1-pentyl-heptyl ester and its isomers, dodecanoic acid-2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexy ester and isomers, dodecanoic acid-1-butyl-2-dodecanoyloxy-hexyl ester and isomers, decanoic acid 1-butyl-2-decanoyloxy-hexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and isomers, dodecanoic acid 2-dodecanoyloxy-1-propyl-pentyl ester and isomers, decanoic acid 2-decanoyloxy-1-propyl-pentyl ester and isomers, octanoic acid 1-2-octanoyloxy-1-propyl-pentyl ester and isomers, hexanoic acid 2-hexanoyloxy-1-propyl-pentyl ester and isomers and mixtures thereof.

Methods which can be employed in making diesters are further described for example in U.S. Patent Application Publications 2009/0159837 and 2009/0198075. More specifically, in some embodiments, processes for making diester species comprise: epoxidizing an olefin (or quantity of olefins) having a carbon number of from 8 to 16 to form an epoxide comprising an epoxide ring; opening the epoxide ring to form a diol; and esterifying (i.e., subjecting to esterification) the diol with an esterifying species to form a diester species, wherein such esterifying species are selected from the group consisting of carboxylic acids, acyl acids, acyl halides, acyl anhydrides and combinations thereof; wherein such esterifying species have a carbon number from 2 to 18; and wherein the diester species have a viscosity of about 3 $mm^2/sec$ or more at a temperature of 100° C.

Diester species may be prepared by epoxidizing an olefin having from about 8 to about 16 carbon atoms to form an epoxide comprising an epoxide ring. The epoxidized olefin is reacted directly with an esterifying species to form a diester species, wherein the esterifying species is selected from the group consisting of carboxylic acids, acyl halides, acyl anhydrides, and combinations thereof, wherein the esterifying species has a carbon number of from 2 to 18, and wherein the diester species has a viscosity and a pour point suitable for use as a finished oil.

In some embodiments, where a quantity of diester species is formed, the quantity of diester species can be substantially homogeneous, or it can be a mixture of two or more different such diester species.

In some embodiments, the olefin used is a reaction product of a Fischer-Tropsch process. In these or other embodiments, the carboxylic acid can be derived from alcohols generated by a Fischer-Tropsch process and/or it can be a bio-derived fatty acid.

In some embodiments, the olefin is an α-olefin (i.e., an olefin having a double bond at a chain terminus). In such embodiments, it is usually necessary to isomerize the olefin so as to internalize the double bond. Such isomerization is typically carried out catalytically using a catalyst such as, but not limited to, crystalline aluminosilicate and like materials and aluminophosphates. See, e.g., U.S. Pat. Nos. 2,537,283; 3,211,801; 3,270,085; 3,327,014; 3,304,343; 3,448,164; 4,593,146; 3,723,564 and 6,281,404.

Fischer-Tropsch alpha olefins (α-olefins) can be isomerized to the corresponding internal olefins followed by epoxidation. The epoxides can then be transformed to the corresponding diols via epoxide ring opening followed by di-acylation (i.e., di-esterification) with the appropriate carboxylic acids or their acylating derivatives. It is typically necessary to convert alpha olefins to internal olefins because diesters of alpha olefins, especially short chain alpha olefins, tend to be solids or waxes. "Internalizing" alpha olefins followed by transformation to the diester functionalities introduces branching along the chain which reduces the pour point of the intended products. The ester groups with their polar character would further enhance the viscosity of the final product. Adding ester branches will increase the carbon number and hence viscosity. It can also decrease the associated pour and cloud points. In some embodiments, there may be a few longer branches rather than many short branches, as increased branching tends to lower the viscosity index (VI).

Regarding the step of epoxidizing (i.e., the epoxidation step), in some embodiments, the above-described olefin (in one embodiment an internal olefin) can be reacted with a peroxide (e.g., $H_2O_2$) or a peroxy acid (e.g., peroxyacetic acid) to generate an epoxide. See, e.g., D. Swern, in Organic Peroxides Vol. II, Wiley-Interscience, New York, 1971, pp. 355-533; and B. Plesnicar, in Oxidation in Organic Chemistry, Part C, W. Trahanovsky (ed.), Academic Press, New York 1978, pp. 221-253. Olefins can be efficiently transformed to the corresponding diols by highly selective reagent such as osmium tetra-oxide (M. Schroder, Chem. Rev. vol. 80, p. 187, 1980) and potassium permanganate (Sheldon and Kochi, in Metal-Catalyzed Oxidation of Organic Compounds, pp. 162-171 and 294-296, Academic Press, New York, 1981).

Regarding the step of epoxide ring opening to the corresponding diol, this step can be acid-catalyzed or based-catalyzed hydrolysis. Exemplary acid catalysts include, but are not limited to, mineral-based Brönsted acids (e.g., HCl, $H_2SO_4$, $H_3PO_4$, perhalogenates, etc.), Lewis acids (e.g., $TiCl_4$ and $AlCl_3$) solid acids such as acidic aluminas and silicas or their mixtures, and the like. See, e.g., Chem. Rev. vol. 59, p. 737, 1959; and Angew. Chem. Int. Ed., vol. 31, p. 1179, 1992. Based-catalyzed hydrolysis typically involves the use of bases such as aqueous solutions of sodium or potassium hydroxide.

Regarding the step of esterifying (esterification), an acid is typically used to catalyze the reaction between the —OH groups of the diol and the carboxylic acid(s). Suitable acids include, but are not limited to, sulfuric acid (Munch-Peterson, Org. Synth., V, p. 762, 1973), sulfonic acid (Allen and Sprangler, Org. Synth., III, p. 203, 1955), hydrochloric acid (Eliel et al., Org. Synth., IV, p. 169, 1963), and phosphoric acid (among others). In some embodiments, the carboxylic acid used in this step is first converted to an acyl chloride (via, e.g., thionyl chloride or $PCl_3$). Alternatively, an acyl chloride could be employed directly. Wherein an acyl chloride is used, an acid catalyst is not needed and a base such as pyridine, 4-dimethylaminopyridine (DMAP) or triethylamine (TEA) is typically added to react with an HCl produced. When pyridine or DMAP is used, it is believed that these amines also act as a catalyst by forming a more reactive acylating intermediate. See, e.g., Fersh et al., J. Am. Chem. Soc., vol. 92, pp. 5432-5442, 1970; and Hofle et al., Angew. Chem. Int. Ed. Engl., vol. 17, p. 569, 1978.

Regardless of the source of the olefin, in some embodiments, the carboxylic acid used in the above-described method is derived from biomass. In some such embodiments, this involves the extraction of some oil (e.g., triglyceride) component from the biomass and hydrolysis of the triglycerides of which the oil component is comprised so as to form free carboxylic acids.

In some embodiments, a triester component has the following chemical structure:

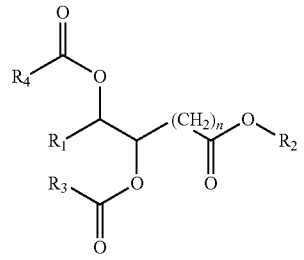

wherein $R_1$, $R_2$, $R_3$, and $R_4$ are independently selected from $C_2$ to $C_{20}$ hydrocarbon groups (hydrocarbon groups with from 2 to 20 carbon atoms), and wherein "n" is an integer from 2 to 20.

Selection of $R_1$, $R_2$, $R_3$ and $R_4$, and n can follow any or all of several criteria. For example, in some embodiments, $R_1$, $R_2$, $R_3$ and $R_4$ and n are selected such that the kinematic viscosity of the composition at a temperature of 100° C. is typically about 3 $mm^2$/sec or greater. In some or other embodiments, $R_1$, $R_2$, $R_3$, and $R_4$ and n are selected such that the pour point of the resulting finished oil is about −10° C. or lower, e.g., about −25° C. or about −40° C. or lower. In some embodiments, $R_1$ is selected to have a total carbon number of from 6 to 12. In these or other embodiments, $R_2$ is selected to have a carbon number of from 1 to 20. In these or other embodiments, $R_3$ and $R_4$ are selected to have a combined carbon number of from 4 to 36. In these or other embodiments, n is selected to be an integer from 5 to 10. Depending on the embodiment, such resulting triester species can typically have a molecular mass from about 400 amu or about 450 amu to about 1000 amu or about 1100 amu.

In some embodiments, the ester component may be substantially homogeneous in terms of its triester component. In some other embodiments, the triester component comprises a variety (i.e., a mixture) of triester species. In these or other embodiments, such above-described triester components further comprise one or more triester species.

In some of the above-described embodiments, a triester component comprises one or more triester species of the type 9,10-bis-alkanoyloxy-oetadecanoic acid alkyl ester and isomers and mixtures thereof, where the alkyl is selected from the group consisting of methyl, ethyl, propyl, butyl, pentyl, hexyl, heptyl, octyl, nonyl, decyl, undecyl, dodecyl, tridecyl, tetradecyl, pentadecyl, hexadecyl, and octadecyl; and where the alkanoyloxy is selected from the group consisting of ethanoyloxy, propanoyoxy, butanoyloxy, pentanoyloxy, hexanoyloxy, heptanoyloxy, octanoyloxy, nonaoyloxy, decanoyloxy, undacanoyloxy, dodecanoyloxy, tridecanoyloxy, tetradecanoyloxy, pentaclecanoyloxy, hexadeconoyloxy, and octadecanoyloxy, 9,10-bis-hexanoyloxy-octadecanoic acid hexyl ester and 9,10-bis-decanoyloxy-octadecanoic acid decyl ester are exemplary such triesters.

One method of preparing triester species is described in U.S. Pat. No. 7,544,645. In some embodiments, processes for making triester species comprises the steps: esterifying (i.e., subjecting to esterification) a mono-unsaturated fatty acid (or quantity of mono-unsaturated fatty acids) having a carbon number of from 10 to 22 with an alcohol to form an unsaturated ester (or a quantity thereof); epoxidizing the unsaturated ester to form an epoxy-ester species comprising an epoxide ring; opening the epoxide ring of the epoxy-ester species to form a dihydroxy-ester: and esterifying the dihydroxy-ester with an esterifying species to form a triester species, wherein such esterifying species are selected from the group consisting of carboxylic acids, acyl halides, acyl anhydrides, and combinations thereof; and wherein such esterifying species have a carbon number of from 2 to 19.

In another embodiment, the method can comprise reducing a monosaturated fatty acid to the corresponding unsaturated alcohol. The unsaturated alcohol is then epoxidized to an epoxy fatty alcohol. The ring of the epoxy fatty alcohol is opened to make the corresponding triol; and then the triol is esterified with an esterifying species to form a triester species, wherein the esterifying species is selected from the group consisting of carboxylic acids, acyl halides, acyl anhydrides and combinations thereof, and wherein the esterifying species has a carbon number of from 2 to 19. The structure of a triester prepared by the foregoing method would be as follows:

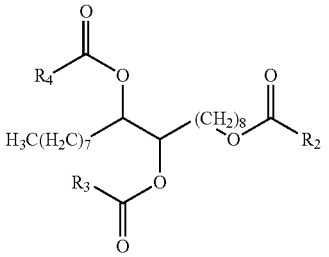

wherein $R_2$, $R_3$ and $R_4$ are independently selected from $C_2$ to $C_{20}$ hydrocarbon groups, for instance selected from $C_4$ to $C_{12}$ hydrocarbon groups.

In another embodiment, the method can comprise reducing a monosaturated fatty acid to the corresponding unsaturated alcohol; epoxidizing the unsaturated alcohol to an epoxy fatty alcohol; and esterifying the fatty alcohol epoxide with an esterifying species to form a triester species, wherein the esterifying species is selected from the group consisting of carboxylic acids, acyl halides, acyl anhydrides, and combinations thereof and wherein the esterifying species has a carbon number of from 2 to 19.

In some embodiments, where a quantity of triester species is formed, the quantity of triester species can be substantially homogeneous, or it can be a mixture of two or more different such triester species. Additionally or alternatively, in some embodiments, such methods further comprise a step of blending a triester composition(s) with one or more diester species.

In some embodiments, such methods produce compositions comprising at least one triester species of the type 9,10-bis-alkanoyloxy-octadecanoic acid alkyl ester and isomers and mixtures thereof where the alkyl is selected from the group consisting of methyl, ethyl, propyl, butyl, pentyl, hexyl, heptyl, octyl, nonyl, decyl, undecyl, dodecyl, tridecyl, tetradecyl, pentadecyl, hexadecyl and octadecyl; and where the alkanoyloxy is selected from the group consisting of ethanoyloxy, propanoyoxy, butanoyloxy, pentanoyloxy, hexanoyloxy, heptanoyloxy, octanoyloxy, nonaoyloxy, decanoyloxy, undacanoyloxy, dodecanoyloxy, tridecanoyloxy, tetradecanoyloxy, pentadecanoyloxy, hexadeconoyloxy, and octadecanoyloxy. Exemplary such triesters include, but not limited to, 9,10-bis-hexanoyloxy-octadecanoic acid hexyl ester; 9,10-bis-octanoyloxy-octadecanoic acid hexyl ester; 9,10-bis-decanoyloxy-octadecanoic acid hexyl ester; 9,10-bis-dodecanoyoxy-octadecanoic acid hexyl ester; 9,10-bis-hexanoyloxy-octadecanoic acid decyl ester; 9,10-bis-decanoyloxy-octadecanoic acid decyl ester; 9,10-bis-octanoyloxy-octadecanoic acid decyl ester; 9,10-bis-dodecanoyloxy-octadecanoic acid decyl ester; 9,10-bis-hexanoyloxy-octadecanoic acid octyl ester; 9,10-bis-octanoyloxy-octadecanoic acid octyl ester: 9,10-bis-decanoyloxy-octadecanoic acid octyl ester; 9,10-bis-dodecanoyloxy-octadecanoic acid octyl ester; 9,10-bis-hexanoyloxy-octadecanoic acid dodecyl ester; 9,10-bis-octanoyloxy-octadecanoic acid dodecyl ester; 9,10-bis-decanoyloxy-octadecanoic acid dodecyl ester; 9,10-bis-doclecanoyloxy-octadecanoic acid dodecyl ester; and mixtures thereof.

In some such above-described method embodiments, the mono-unsaturated fatty acid can be a bio-derived fatty acid. In some or other such above-described method embodiments, the alcohol(s) can be FT-produced alcohols.

In some method embodiments, the step of esterifying (i.e., esterification) the mono-unsaturated fatty acid can proceed via an acid-catalyzed reaction with an alcohol using, e.g., $H_2SO_4$ as a catalyst. In some or other embodiments, the esterifying can proceed through a conversion of the fatty acid(s) to an acyl halide (chloride, bromide, or iodide) or acyl anhydride, followed by reaction with an alcohol.

Regarding the step of epoxidizing (i.e., the epoxidation step), in some embodiments, the above-described mono-unsaturated ester can be reacted with a peroxide (e.g., $H_2O_2$) or a peroxy acid (e.g., peroxyacetic acid) to generate an epoxy-ester species. See, e.g., D. Swern, in Organic Peroxides Vol. II, Wiley-Interscience, New York, 1971, pp. 355-533; and B. Plesnicar, in Oxidation in Organic Chemistry, Part C, W. Trahanovsky (ed.), Academic Press, New York 1978, pp. 221-253. Additionally or alternatively, the olefinic portion of the mono-unsaturated ester can be efficiently transformed to the corresponding dihydroxy ester by highly selective reagents such as osmium tetra-oxide (M. Schroder, Chem. Rev. vol. 80, p. 187, 1980) and potassium permanganate (Sheldon and Kochi, in Metal-Catalyzed Oxidation of Organic Compounds, pp. 162-171 and 294-296, Academic Press, New York, 1981).

Regarding the step of epoxide ring opening to the corresponding dihydroxy-ester, this step is usually an acid-catalyzed hydrolysis. Exemplary acid catalysts include, but are not limited to, mineral-based Brönsted acids (e.g., HCl, $H_2SO_4$, $H_3PO_4$, perhalogenates, etc.), Lewis acids (e.g., $TiCl_4$ and $AlCl_3$), solid acids such as acidic aluminas and silicas or their mixtures, and the like. See, e.g., Chem. Rev. vol. 59, p. 737, 1959; and Angew. Chem. Int. Ed., vol. 31, p. 1179, 1992. The epoxide ring opening to the diol can also be accomplished by base-catalyzed hydrolysis using aqueous solutions of KOH or NaOH.

Regarding the step of esterifying the dihydroxy-ester to form a triester, an acid is typically used to catalyze the reaction between the —OH groups of the diol and the carboxylic acid(s). Suitable acids include, but are not limited to, sulfuric acid (Munch-Peterson, Org. Synth., V, p. 762, 1973), sulfonic acid (Allen and Sprangler, Org Synth., III, p. 203, 1955), hydrochloric acid (Eliel et al., Org Synth., IV, p. 169, 1963), and phosphoric acid (among others). In some embodiments, the carboxylic acid used in this step is first converted to an acyl chloride (or another acyl halide) via, e.g., thionyl chloride or $PCl_3$. Alternatively, an acyl chloride (or other acyl halide) could be employed directly. Where an acyl chloride is used, an acid catalyst is not needed and a base such as pyridine, 4-dimethylaminopyridine (DMAP) or triethylamine (TEA) is typically added to react with an HCl produced. When pyridine or DMAP is used, it is believed that these amines also act as a catalyst by forming a more reactive acylating intermediate. See, e.g., Fersh et al., J. Am. Chem. Soc., vol. 92, pp. 5432-5442, 1970; and Hofle et al., Angew. Chem. Int. Ed. Engl., vol. 17, p. 569, 1978. Additionally or alternatively, the carboxylic acid could be converted into an acyl anhydride and/or such species could be employed directly.

Regardless of the source of the mono-unsaturated fatty acid, in some embodiments, the carboxylic acids (or their acyl derivatives) used in the above-described methods may be derived from biomass. In some such embodiments, this involves the extraction of some oil (e.g., triglyceride) component from the biomass and hydrolysis of the triglycerides of which the oil component is comprised so as to form free carboxylic acids.

In some particular embodiments, wherein the above-described method uses oleic acid for the mono-unsaturated fatty acid, the resulting triester is of the type:

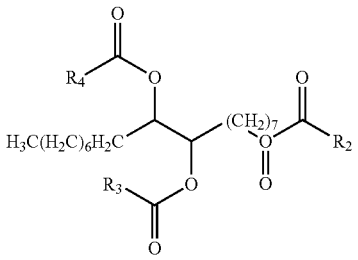

wherein $R_2$, $R_3$ and $R_4$ are independently selected from $C_2$ to $C_{20}$ hydrocarbon groups, for instance selected from $C_4$ to $C_{12}$ hydrocarbon groups.

Using a synthetic strategy in accordance with that outlined above, oleic acid can be converted to triester derivatives (9,10-bis-hexanoyloxy-octadecanoic acid hexyl ester) and (9,10-bis-decanoyloxy-octadecanoic acid decyl ester). Oleic acid is first esterified to yield a mono-unsaturated ester. The mono-unsaturated ester is subjected to an epoxidation agent to give an epoxy-ester species, which undergoes ring-opening to yield a dihydroxy ester, which can then be reacted with an acyl chloride to yield a triester product.

The strategy of the above-described synthesis utilizes the double bond functionality in oleic acid by converting it to the diol via double bond epoxidation followed by epoxide ring opening. Accordingly, the synthesis begins by converting oleic acid to the appropriate alkyl oleate followed by epoxidation and epoxide ring opening to the corresponding diol derivative (dihydroxy ester).

Variations (i.e., alternate embodiments) on the above-described processes include, but are not limited to, utilizing mixtures of isomeric olefins and or mixtures of olefins having a different number of carbons. This may lead to diester mixtures and triester mixtures in an ester component.

Variations on the above-described processes include, but are not limited to, using carboxylic acids derived from FT alcohols by oxidation.

In some embodiments, a base stock comprises a mixture of one or more PAOs and one or more esters.

N-α-naphthyl-N-phenylamine antioxidants (PANA) may be of formula

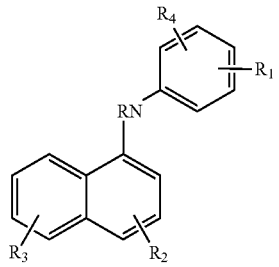

wherein

R is H, $C_1$-$C_{18}$ alkyl, $C_2$-$C_{18}$ alkenyl, $C_2$-$C_{18}$ alkynyl, —C(O)$C_1$-$C_{18}$ alkyl or —C(O)aryl and $R_1$, $R_2$, $R_3$ and $R_4$ are each independently H, $C_1$-$C_{18}$ alkyl, $C_1$-$C_{18}$ alkoxy, $C_1$-$C_{18}$ alkylamino, $C_1$-$C_{18}$ dialkylamino, $C_1$-$C_{18}$ alkylthio, $C_2$-$C_{18}$ alkenyl, $C_2$-$C_{18}$ alkynyl or $C_7$-$C_{21}$ aralkyl.

In some embodiments, PANA antioxidants are of formula

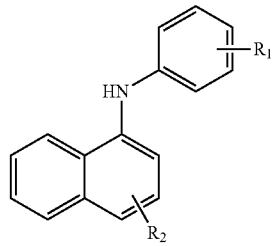

wherein $R_1$ and $R_2$ are each independently H or $C_1$-$C_{18}$ alkyl. In certain embodiments $R_2$ is H and $R_1$ is a branched chain $C_4$-$C_{12}$ alkyl, for example t-butyl, t-octyl or branched nonyl.

Diphenylamine (DPA) antioxidants may be of formula

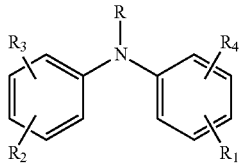

wherein

R is H, $C_1$-$C_{18}$ alkyl, $C_2$-$C_{18}$ alkenyl, $C_2$-$C_{18}$ alkynyl, —C(O)$C_1$-$C_{18}$ alkyl or —C(O)aryl and $R_1$, $R_2$, $R_3$ and $R_4$ are each independently H, $C_1$-$C_{18}$ alkyl, $C_1$-$C_{18}$ alkoxy, $C_1$-$C_{18}$ alkylamino, $C_1$-$C_{18}$ dialkylamino, $C_1$-$C_{18}$ alkylthio, $C_2$-$C_{18}$ alkenyl, $C_2$-$C_{18}$ alkynyl or $C_7$-$C_{21}$ aralkyl.

In certain embodiments, diphenylamine antioxidants may be of formula

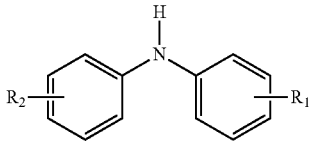

wherein $R_1$ and $R_2$ are each independently H, $C_1$-$C_{18}$ alkyl, $C_2$-$C_{18}$ alkenyl or $C_7$-$C_{21}$ aralkyl. In certain embodiments, $R_1$ and $R_2$ are each independently H, tert-butyl, tert-octyl or branched nonyl.

Alkyl groups are straight or branched chain and include methyl, ethyl, propyl, isopropyl, n-butyl, sec-butyl, isobutyl, tert-butyl, 2-ethylbutyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl, tert-octyl, 2-ethylhexyl, 1,1,3-trimethylhexyl, 1,1,3,3-tetramethylpentyl, nonyl, decyl, undecyl, 1-methylundecyl, dodecyl, 1,1,3,3,5,5-hexamethylhexyl, tridecyl, tetradecyl, pentadecyl, hexadecyl, heptadecyl and octadecyl. Alkyl groups mentioned herein are linear or branched.

The alkyl portion of alkoxy, alkylamine, dialkylamino and alkylthio groups are linear or branched and include the alkyl groups mentioned above.

Alkenyl is an unsaturated alkyl, for instance allyl. Alkynyl includes a triple bond.

Aralkyl includes benzyl, α-methylbenzyl, α,α-dimethylbenzyl, 2-phenylethyl and 2-phenyl-2-propyl.

Cycloalkyl includes cyclopentyl, cyclohexyl and cycloheptyl.

Suitable sulfur-containing additives, according to embodiments, may be sulfur containing additives that comprise up to 7 carbon atoms. In one embodiment, the sulfur-containing additive may be a sulfurized isobutylene (e.g., CAS #68511-50-2). The sulfur-containing additive may comprise a mixture of sulfur compounds, e.g., with a varying number of sulfur atoms.

For instance, the mixture of sulfur compounds may comprise sulfurized isobutylene with one sulfur atom, sulfurized isobutylene with two sulfur atoms, sulfurized isobutylene with three sulfur atoms, sulfurized isobutylene with four sulfur atoms, sulfurized isobutylene with five sulfur atoms, and mixtures thereof.

In some embodiments, the mixture of sulfur compounds may comprise: 1) from about 2.5% to about 12.5%, from about 5% to about 10%, or from about 7% to about 8% sulfurized isobutylene with one sulfur atom; 2) from about 32.5% to about 42.5%, from about 35% to about 40%, or from about 37% to about 38%, or from about 38% to about 39% sulfurized isobutylene with two sulfur atoms; 3) from about 30% to about 40%, from about 32.5% to about 37.5%, or from about 34% to about 36%, or from about 36% to about 37% sulfurized isobutylene with three sulfur atoms; 4) from about 5% to about 15%, from about 7.5% to about 12.5%, or from about 9% to about 11% sulfurized isobutylene with four sulfur atoms; 5) from about 1% to about 11%, from about 4% to about 9%, or from about 6% to about 7% of sulfurized isobutylene with five carbon atoms; or any mixture thereof of any one of 1) through 5). In one embodiment, the percentages are in wt % calculated based on the total weight of the mixture of sulfur compounds. In one embodiment, the percentages being indicative of sulfide area % resulting from gas chromatography—mass spectrometry (GC-MS) analysis of a sample containing the mixture of sulfur compounds in dichloromethane. The gas chromatography analysis being performed on an Agilent 7890 A instrument, ZB-Semi Volatiles 30 m×0.25 mm×0.25 μm column, helium carrier gas, Flame Ionization Detector (FID) at a detector temperature of about 290° C., injector temperature of about 260° C., split of about 10:1, and a temperature program in accordance with the following table:

| Rate (° C./min) | Temperature (° C.) | Retention Period (minute) |
|---|---|---|
| | 40 | 1 |
| 15 | 320 | 10 |

In some embodiments, the lubricant composition may further comprise at least one additional sulfur-containing lubricant additives including sulfur-containing hindered phenolic compounds, sulfur-containing rust inhibitors, sulfur-containing friction modifiers and sulfur-containing antiwear additives.

Sulfur-containing hindered phenolic compounds include alkylthiomethylphenols, for example 2,4-di-octylthiomethyl-6-tert-butylphenol, 2,4-di-octylthiomethyl-6-methylphenol, 2,4-di-octylthiomethyl-6-ethylphenol or 2,6-di-dodecylthiomethyl-4-nonylphenol; hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis-(6-tert-butyl-2-methylphenol), 4,4'-thiobis(3,6-di-sec-amylphenol) or 4,4'-bis(2,6-dimethyl-4-hydroxyphenyl) disulfide; S-benzyl compounds, for example octadecyl 4-hydroxy-3,5-dimethylbenzylmercaptoacetate, tridecyl 4-hydroxy-3,5-di-tert-butylbenzylmercaptoacetate, bis(4-tert-butyl-3-hydroxy-2,6-dimethylbenzyl)dithioterephthalate, bis(3,5-di-tert-butyl-4-hydroxybenzyl) sulfide or isooctyl 3,5-di-tert-butyl-4-hydroxy-benzylmercaptoacetate; and esters of β-(3,5-di-tert-butyl-4-hydroxyphenyl)propionic acid, β-(5-tert-butyl-4-hydroxy-3-methylphenyl)propionic acid, β-(3,5-dicyclohexyl-4-hydroxyphenyl)-propionic acid, 3,5-di-tert-butyl-4-hydroxyphenylacetic acid or β-(5-tert-butyl-4-hydroxyphenyl)-3-thiabutyric acid with sulfur-containing mono- or polyhydric alcohols such as thiodiethylene glycol, 3-thiaundecanol or thiapentadecanol.

Sulfur-containing rust inhibitors include, for example, barium dinonylnaphthalene-sulfonates, calcium petroleum-sulfonates, alkylthio-substituted aliphatic carboxylic acids, esters of aliphatic 2-sulfocarboxylic acids and salts thereof.

Sulfur-containing friction modifiers may for example be selected from organomolybdenum dithiocarbamates, organomolybdenum dithiophosphates and organomolybdenum compounds based on dispersants and molybdenum disulfide.

Sulfur-containing antiwear additives include sulfurized olefins and vegetable oils, dialkyldithiophosphate esters, zinc dialkyldithiophosphates, alkyl and aryl di- and trisulfides, derivatives of 2,5-dimercapto-1,3,4-thiadiazole, ethyl (bisisopropyloxyphosphinothioyl)-thiopropionate, triphenyl thiophosphate (triphenyl phosphorothioate), tris(alkylphenyl) phosphorothioates and mixtures thereof (for example tris(isononylphenyl) phosphorothioate), diphenylmononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris-isooctyl 2-acetate, derivatives of 2-mercaptobenzothiazole, such as 1-N,N-bis(2-ethylhexyl)aminomethyl-2-mercapto-1H-1,3-benzothiazole, and ethoxycarbonyl 5-octyldithiocarbamate; and dihydrocarbyl dithiophosphate metal salts where the metal may be aluminum, lead, tin manganese, cobalt, nickel, zinc or copper.

A zinc dialkyldithiophosphate salt may be represented as

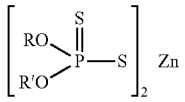

where R and R' are independently $C_1$-$C_{20}$ alkyl, $C_3$-$C_{20}$ alkenyl, $C_5$-$C_{12}$ cycloalkyl, $C_7$-$C_{13}$ aralkyl or $C_6$-$C_{10}$ aryl, for example R and R' are independently $C_1$-$C_{12}$ alkyl.

In some embodiments, the lubricants may be substantially free or free of zinc dialkyldithiophosphates. The term "substantially free" may mean "not intentionally added", for example may mean ≤1000 ppm, ≤750 ppm, ≤500 ppm, ≤250 ppm, ≤1000 ppm, ≤75 ppm, ≤50 ppm, ≤25 ppm, ≤10 ppm, ≤5 ppm, ≤2 ppm or ≤1 ppm of a zinc dialkyldithiophosphate (or other referenced component) may be present, by weight, based on the weight of the total composition.

A dialkyldithiophosphate ester may be represented as

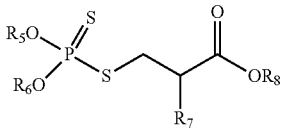

in which $R_5$ and $R_6$ independently of one another are $C_3$-$C_{16}$alkyl, $C_5$-$C_{12}$ cycloalkyl, $C_5$-$C_6$ cycloalkylmethyl, $C_9$-$C_{10}$ bicycloalkylmethyl, $C_9$-$C_{10}$ tricycloalkylmethyl, phenyl or $C_7$-$C_{24}$ alkylphenyl or together are $(CH_3)_2C(CH_2)_2$ and $R_7$ and $R_8$ are independently hydrogen or $C_1$-$C_{18}$ alkyl. For example, a dialkyl dithiophosphate ester, CAS #268567-32-4.

In some embodiments, the at least one additional sulfur-containing additives include sulfurized olefins. Suitable olefins include isobutylene, other butylenes, pentenes, propene, mixtures thereof and oligomers thereof. In a certain embodiment, the sulfur-containing additives include sulfurized isobutylene. Sulfurized olefins are described in, for example, U.S. Pat. Nos. 3,471,404, 3,697,499, 3,703,504, 4,194,980, 4,344,854, 5,135,670, 5,338,468 and 5,849,677. Sulfurized olefins include sulfur-containing polyolefins, for example sulfur-containing polyisobutylene compounds, for example, as described in U.S. Pat. No. 6,410,491 and US2005/0153850. In general, sulfurized olefins may be prepared by treating an olefin or an olefinic oligomer or polymer, such as isobutylene or polyisobutylene, with a source of sulfur such as elemental sulfur, hydrogen sulfide or sulfuric acid. Sulfurized olefins include sulfurized polyolefins, for example sulfurized isobutylene includes sulfurized polyisobutylene.

In certain embodiments, sulfur-containing additives may include one or more di-tert-alkyl polysulfides such as di-tert-butyl polysulfide (CAS #68937-96-2), di-tert-dodecyl polysulfide (CAS #68425-15-0) or di-tert-nonyl polysulfide.

The one or more N-α-naphthyl-N-phenylamine antioxidants and the one or more diphenylamine antioxidants, together in total, may be present from any of about 0.20 wt % (weight percent), about 0.25 wt %, about 0.30 wt %, about 0.35 wt %, about 0.40 wt %, about 0.45 wt % or about 0.50 wt % to any of about 0.55 wt %, about 0.60 wt %, about 0.65 wt %, about 0.70 wt %, about 0.75 wt % or about 0.80 wt %, based on the total weight of the formulated lubricant composition.

The one or more N-α-naphthyl-N-phenylamine antioxidants and the one or more diphenylamine antioxidants may be present in a weight/weight ratio of from any of about 1/9, about 1/8, about 1/7, about 1/6, about 1/5, about 1/4, about 1/3, about 1/2 or about 1/1 to any of about 2/1, about 3/1, about 4/1, about 5/1, about 6/1, about 7/1, about 8/1 or about 9/1. In certain embodiments, the weight/weight ratio of the one or more N-α-naphthyl-N-phenylamine antioxidants to the one or more diphenylamine antioxidants may be from any of about 1/1, about 1/2, about 1/3 or about 1/4 to any of about 1/5, about 1/6, about 1/7, about 1/8 or about 1/9. In other embodiments, the weight/weight ratio of the one or more N-α-naphthyl-N-phenylamine antioxidants to the one or more diphenylamine antioxidants may be from about 1/1 or about 1/2 to about 1/3.

The sulfur as provided by the sulfur-containing additive(s), in total, may be present from any of about 50 ppm (parts per million), about 75 ppm, about 100 ppm, about 125 ppm, about 150 ppm, about 175 ppm about 200 ppm, about 225 ppm, about 250 ppm, about 275 ppm, about 300 ppm, about 325 ppm, about 350 ppm, about 375 ppm, about 400 ppm or about 425 ppm to any of about 450 ppm, about 475 ppm, about 500 ppm, about 525 ppm, about 550 ppm, about 575 ppm, about 600 ppm, about 625 ppm, about 650 ppm, about 675 ppm, about 700 ppm, about 725 ppm, about 750 ppm, about 775 ppm, about 800 ppm, about 825 ppm, about 850 ppm, about 875 ppm, about 900 ppm, about 925 ppm, about 950 ppm, about 975 ppm or about 1000 ppm, by weight, based on the total weight of the lubricant composition.

The lubricant compositions may further comprise one or more non-sulfur-containing lubricant additives selected from the group consisting of further antioxidants, antiwear agents, dispersants, detergents, corrosion inhibitors, rust inhibitors, metal deactivators, extreme pressure additives, anti-seizure agents, wax modifiers, viscosity index improvers, viscosity modifiers, fluid-loss additives, seal compatibility agents, organic metallic friction modifiers, lubricity agents, anti-staining agents, chromophoric agents, anti-foam agents, demulsifiers, emulsifiers, densifiers, wetting agents, gelling agents, tackiness agents, colorants and others.

In certain embodiments, the lubricant composition may comprise an additive package, the additive package comprising a) one or more N-α-naphthyl-N-phenylamine antioxidants and/or b) one or more diphenylamine antioxidants; and c) a sulfur-containing additive comprising up to 7 carbon atoms; and wherein c) is present from about 2 wt % to about 30 wt %, based on the total weight of a)+b)+c). The weight/weight ratio of a) to b) may be further described as above. In some embodiments, component c) may be present from any of about 2 wt %, about 5 wt %, about 10 wt %, about 15 wt % or about 20 wt % to any of about 25 wt %, about 30 wt %, based on the total weight of a)+b)+c). In some embodiments, a weight/weight ratio of a) to b) is from about 1/1 to about 1/9.

The additive package may further comprise one or more non-sulfur-containing lubricant additives, for example one or more anti-foam agents and/or one or more corrosion inhibitors. In some embodiments, an additive package may be present from any of about 0.30 wt % (weight percent), about 0.35 wt %, about 0.40 wt %, about 0.45 wt %, about 0.50 wt %, about 0.55 wt % or about 0.60 wt % to any of about 0.65 wt %, about 0.70 wt %, about 0.75 wt %, about 0.80 wt %, about 0.85 wt % or about 0.90 wt %, based on the total weight of the formulated lubricant composition.

The base oil, the one or more N-α-naphthyl-N-phenylamine antioxidants, the one or more diphenylamine antioxidants, the sulfur-containing additive and optional further additives, in total, equal 100% by weight.

Further additives include the following inhibitors, antirust additives and metal deactivators.

Antirust additives (or corrosion inhibitors) are additives that protect lubricated metal surfaces against chemical attack by water or other contaminants. A wide variety of these are commercially available. Suitable corrosion inhibitors include alkenyl succinic acids and carboxylic acids or esters thereof, together with an amine phosphate salt. Metal deactivators include triazole derivatives.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dialkyldithiophosphates, metal phenolates, basic metal sulfonates, fatty acids and amines. Such additives may be used in an amount of 0.01 to 5 weight percent, preferably 0.01 to 1.5 weight percent.

The present additive compositions can be introduced into a lubricant in manners known per se. The compounds are readily soluble in oils. They may be added directly to the lubricant or they can be diluted with a substantially inert, normally liquid organic diluent such as an organic solvent including naphtha, benzene, toluene and xylene or a normally liquid oil or fuel to form an additive concentrate or masterbatch. Additive concentrates may include base stocks, such as ester base stocks, as a diluent. In certain embodiments, additive concentrates include solvents such as glymes, such as monomethyl tetraglyme.

These concentrates generally contain from about 10% to about 90% by weight additive and may contain one or more other additional additives. The present additive compositions may be introduced as part of an additive package.

The additive compositions of this disclosure may advantageously be diluted with one or more liquid additives disclosed herein, for instance one or more liquid dispersants, detergents, antiwear additives, corrosion inhibitors or antioxidants mentioned herein to prepare an antioxidant additive package.

The term "base oil" is synonymous with "base stock", "lubricating base oil" or "lubricating base stock".

The term "fully formulated lubricating oil" means a finished lubricating oil for use containing a base stock and an additive package and is synonymous with "formulated oil" or "finished oil".

"Centistoke," abbreviated "cSt," is a unit for kinematic viscosity of a fluid (e.g., a lubricant), wherein 1 centistoke equals 1 millimeter squared per second (1 cSt=1 $mm^2/s$).

The lubricant compositions in some embodiments have a kinematic viscosity at 100° C. of from any one of about 2 cSt, about 3 cSt, about 4 cSt, about 5 cSt, about 6 cSt or about 7 cSt to any one of about 8 cSt, about 9 cSt, about 10 cSt, about 11 cSt, about 12 cSt, about 13 cSt, about 14 cSt, about 15 cSt, about 16 cSt, about 17 cSt, about 18 cSt, about 19 cSt or about 20 cSt.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±5%, ±4%, ±3%, ±2%, ±1%, ±0.5%, ±0.4%, ±0.3%, ±0.2%, ±0.1% or ±0.05%. All numeric values are modified by the term "about" whether or not explicitly indicated. Numeric values modified by the term "about" include the specific identified value. For example "about 5.0" includes 5.0.

U.S. patents, U.S. patent applications and published U.S. patent applications discussed herein are hereby incorporated by reference.

Unless otherwise indicated, all parts and percentages are by weight. Weight percent (wt %), if not otherwise indicated, is based on an entire composition free of any volatiles.

Example 1

A turbine base oil is formulated together with additives as outlined below to provide formulations A-F. Amounts of additives are ppm (parts per million) by weight, based on the total weight of the formulation. Remainder of the total weight is a Group III base oil. Formulations B, D and F are inventive. Formulations A, C and E are comparative. PANA is an alkylated N-α-naphthyl-N-phenylamine antioxidant. DPA is an alkylated diphenylamine antioxidant. The sulfur additive is a di-tert-alkyl polysulfide. Corrosion inhibitors A and B are an alkenyl succinic acid half ester plus amine phosphate salt and a carboxylic acid plus amine phosphate salt, respectively. Metal deactivator is a triazole derivative. Diluent is a glycol type diluent.

| | formulations | | | | | |
|---|---|---|---|---|---|---|
| additives | A | B | C | D | E | F |
| PANA | 1258 | 1258 | 1082 | 1082 | 990 | 990 |
| DPA | 2158 | 2158 | 1856 | 1856 | 1310 | 1310 |
| phenolic AO | — | — | 80 | 80 | — | — |
| sulfur additive | — | 400 | — | 500 | — | 400 |
| corrosion inhibitor A | 400 | 400 | 66 | 66 | 400 | 400 |
| corrosion inhibitor B | — | — | 200 | 200 | — | — |
| metal deactivator | 250 | 250 | 214 | 214 | 250 | 250 |
| diluent | 534 | 534 | 802 | 802 | 165 | 165 |

Testing results according to the Rotating Pressure Vessel Oxidation Test (RPVOT-ASTM D2272) in minutes and according to The Standard Test Method for Corrosiveness and Oxidation Stability of Hydraulic Oils, Aircraft Turbine Engine Lubricants, and Other Highly Refined Oils (ASTM D4636) are found below. Mass change for a metal is reported in $mg/cm^2$. Acid number increase is reported in mgKOH/g.

| | test results | | | | | |
|---|---|---|---|---|---|---|
| | A | B | C | D | E | F |
| ASTM D2272 (minutes) | 1642 | 2585 | 1001 | 1652 | 1583 | 1950 |
| ASTM D4636 (72 hours at 175° C.) | | | | | | |
| acid number increase | 56.3 | 6.4 | 84.7 | 21.4 | 68.1 | 15.0 |
| viscosity @40° C. % increase | 7.36 | 1.11 | 10.09 | 3.74 | 7.48 | 3.59 |
| mass change steel | 0.00 | 0.00 | 0.00 | 0.00 | 0.00 | 0.00 |
| mass change aluminum | 0.00 | 0.00 | 0.00 | 0.00 | 0.00 | 0.00 |
| mass change cadmium | −6.70 | −0.10 | −7.60 | −1.70 | −5.00 | −0.60 |
| mass change copper | 0.00 | 0.00 | 0.00 | −0.10 | 0.00 | −0.10 |
| mass change magnesium | 0.00 | 0.00 | −17.20 | 0.00 | −11.7 | 0.00 |

Inventive formulations B, D and F are superior according to the ASTM D2272 test as well as the ASTM D4636 test.

Example 2

A turbine base oil is formulated together with additives as outlined below to provide formulations A-E. Amounts of additives are ppm (parts per million) by weight, based on the total weight of the formulation. Remainder of the total weight is a Group III base oil. Formulations A, B, C, and D are inventive. Formulation E is comparative.

PANA is an alkylated N-α-naphthyl-N-phenylamine antioxidant. DPA is an alkylated diphenylamine antioxidant. Corrosion inhibitors A and B are an alkenyl succinic acid half ester plus amine phosphate salt and a carboxylic acid plus amine phosphate salt, respectively. Metal deactivator is a triazole derivative. Diluent is a glycol type diluent. The amount of sulfur as provided by the sulfur containing additives in each of the inventive formulations is 230 ppm.

| | formulations | | | | |
|---|---|---|---|---|---|
| additives | A | B | C | D | E |
| PANA | 1490 | 1490 | 1490 | 1490 | 1490 |
| DPA | 2556 | 2556 | 2556 | 2556 | 2556 |
| corrosion inhibitor A | 296 | 296 | 296 | 296 | 296 |
| corrosion inhibitor B | 178 | 178 | 178 | 178 | 178 |
| metal deactivator | 296 | 296 | 296 | 296 | 296 |
| diluent | 1184 | 1184 | 1184 | 1184 | 1184 |
| phenolic antioxidant containing a thioester group with the chemical structure A depicted below | 4720 | — | — | — | — |
| Di-tert-dodecyl polysulfide (penta-sulfide sulfur derivative) | — | 800 | — | — | — |
| Di-tert-butyl polysulfide (tri and tetra-sulfide sulfur derivative) | — | — | 440 | — | — |
| Sulfurized isobutylene (average distribution: about 7.4% S1, about 37.5% S2, about 35.2% S3, about 10.1% S4, and about 6.6% S5) | — | — | — | 480 | — |

Phenolic antioxidant containing a thioester group with the chemical structure A is:

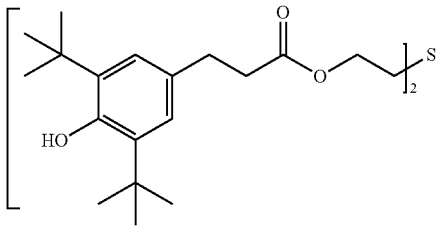

Testing results according to the Rotating Pressure Vessel Oxidation Test (RPVOT-ASTM D2272) in minutes and according to The Standard Test Method for Corrosiveness and Oxidation Stability of Hydraulic Oils, Aircraft Turbine Engine Lubricants, and Other Highly Refined Oils (ASTM D4636) are found below. Mass change for a metal is reported in mg/cm$^2$. Acid number increase is reported in mgKOH/g.

| | test results | | | | |
|---|---|---|---|---|---|
| | A | B | C | D | E |
| ASTM D2272 (minutes) | 927 | 2412 | 2298 | 3023 | 1642 |
| ASTM D4636 (72 hours at 175° C.) | | | | | |
| acid number increase | 0.148 | 0.48 | 2.776 | 0.964 | 7.36 |
| mass change cadmium | 0.06 | 0.06 | −0.30 | −0.06 | −6.70 |

Inventive formulations A through D are superior according to the ASTM D2272 test as well as the ASTM D4636 test.

The superior performance of inventive formulations B-D is evident from ASTM D2272 test since they illustrate a significant improvement in the RPVOT retention time compared to comparative formulation E.

The superior performance of inventive formulations A-D is evident from ASTM D4636 test since they illustrate a lower total acid number increase and a lower cadmium mass change as compared to control formulation E.

The invention claimed is:

1. A lubricant composition comprising a base oil, one or more antioxidants selected from a group consisting of N-α-naphthyl-N-phenylamine antioxidants and diphenylamine antioxidants; and a sulfur-containing additive which is a mixture of sulfurized isobutylene compounds having from 1 to 5 sulfur atoms, wherein the mixture of sulfurized isobutylene compounds comprises from about 2.5% to about 12.5% sulfurized isobutylene with one sulfur atom, about 32.5% to about 42.5% sulfurized isobutylene with two sulfur atoms, from about 30% to about 40% sulfurized isobutylene with three sulfur atoms, from about 5% to about 15% sulfurized isobutylene with four sulfur atoms, and from about 1% to about 11% sulfurized isobutylene with five sulfur atoms, and wherein a total sulfur concentration provided by the sulfur-containing additive ranges from about 50 ppm to about 1000 ppm by weight, based on the total weight of the lubricant composition.

2. The lubricant composition according to claim 1, wherein the N-α-naphthyl-N-phenylamine antioxidants plus diphenylamine antioxidants in total are present from about 0.2 wt % to about 0.8 wt %, based on the total weight of the lubricant composition.

3. The lubricant composition according to claim 1, wherein the N-α-naphthyl-N-phenylamine antioxidants are of formula

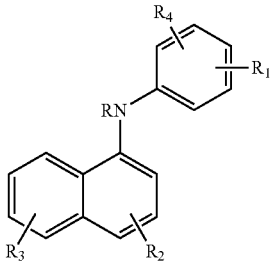

wherein

R is H, $C_1$-$C_{18}$ alkyl, $C_2$-$C_{18}$ alkenyl, $C_2$-$C_{18}$ alkynyl, —C(O)$C_1$-$C_{18}$ alkyl or —C(O)aryl and $R_1$, $R_2$, $R_3$ and $R_4$ are each independently H, $C_1$-$C_{18}$ alkyl, $C_1$-$C_{18}$ alkoxy, $C_1$-$C_{18}$ alkylamino, $C_1$-$C_{18}$ dialkylamino, $C_1$-$C_{18}$ alkylthio, $C_2$-$C_{18}$ alkenyl, $C_2$-$C_{18}$ alkynyl or $C_7$-$C_{21}$ aralkyl; and wherein the diphenylamine antioxidants are of formula

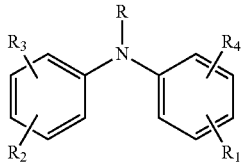

wherein

R is H, $C_1$-$C_{18}$ alkyl, $C_2$-$C_{18}$ alkenyl, $C_2$-$C_{18}$ alkynyl, —C(O)$C_1$-$C_{18}$ alkyl or —C(O)aryl and $R_1$, $R_2$, $R_3$ and $R_4$ are each independently H, $C_1$-$C_{18}$ alkyl, $C_1$-$C_{18}$ alkoxy, $C_1$-$C_{18}$ alkylamino, $C_1$-$C_{18}$ dialkylamino, $C_1$-$C_{18}$ alkylthio, $C_2$-$C_{18}$ alkenyl, $C_2$-$C_{18}$ alkynyl or $C_7$-$C_{21}$ aralkyl.

4. The lubricant composition according to claim 1, further comprising at least one additional sulfur-containing additive selected from a group consisting of sulfur-containing hindered phenolic compounds, sulfur-containing rust inhibitors, sulfur-containing friction modifiers and sulfur-containing antiwear additives.

5. The lubricant composition according to claim 1, comprising one or more N-α-naphthyl-N-phenylamine antioxidants and one or more diphenylamine antioxidants and wherein a weight/weight ratio of N-α-naphthyl-N-phenylamine antioxidants to diphenylamine antioxidants is from about 1/9 to about 9/1.

6. The lubricant composition according to claim 1, wherein the base oil is present from about 80 wt % to about 99.7 wt %, based on the total weight of the lubricant composition.

7. The lubricant composition according to claim 1, wherein the composition is substantially free of zinc dialkyldithiophosphates.

8. An additive package comprising a) one or more N-α-naphthyl-N-phenylamine antioxidants or b) one or more diphenylamine antioxidants; and c) a sulfur-containing additive comprising up to 7 carbon atoms.

9. The additive package according to claim 8, wherein c) is present from about 2 wt % to about 30 wt %, based on the total weight of a)+b)+c).

10. The additive package according to claim 8, comprising a) and b) and wherein a weight/weight ratio of a) to b) is from about 1/1 to about 1/9.

11. An additive concentrate comprising the additive package according to claim 8 and a diluent selected from a group consisting of organic solvents, base stocks and liquid lubricant additives.

12. A process for preparing a lubricant composition, the process comprising incorporating one or more antioxidants selected from a group consisting of N-α-naphthyl-N-phenylamine antioxidants and diphenylamine antioxidants; and a sulfur-containing additive which is a mixture of sulfurized isobutylene compounds having from 1 to 5 sulfur atoms into a base oil, wherein the mixture of sulfurized isobutylene compounds comprises from about 2.5% to about 12.5% sulfurized isobutylene with one sulfur atom, about 32.5% to about 42.5% sulfurized isobutylene with two sulfur atoms, from about 30% to about 40% sulfurized isobutylene with three sulfur atoms, from about 5% to about 15% sulfurized isobutylene with four sulfur atoms, and from about 1% to about 11% sulfurized isobutylene with five sulfur atoms, and wherein a total sulfur concentration provided by the sulfur-containing additive ranges from about 50 ppm to about 1000 ppm by weight, based on the total weight of the lubricant composition.

13. The process according to claim 12, wherein the N-α-naphthyl-N-phenylamine antioxidants plus diphenylamine antioxidants in total are present from about 0.2 wt % to about 0.8 wt %, based on the total weight of the lubricant composition.

14. A process for lubricating a turbine or an engine, the process comprising adding the lubricant composition according to claim 1 to a turbine gearbox or to turbine bearings or to an engine.

* * * * *